US005472282A

United States Patent [19]

Kristola

[11] Patent Number: 5,472,282

[45] Date of Patent: Dec. 5, 1995

[54] QUASI-HEAT SEAL SOS BAG

[75] Inventor: Jay Kristola, Kiel, Wis.

[73] Assignee: H. G. Weber & Company, Inc., Kiel, Wis.

[21] Appl. No.: 235,925

[22] Filed: May 2, 1994

[51] Int. Cl.[6] ..... B65D 30/18

[52] U.S. Cl. ..... 383/125

[58] Field of Search ..... 383/124, 125, 383/126

[56] References Cited

U.S. PATENT DOCUMENTS

| | | | |
|---|---|---|---|
| 333,523 | 1/1886 | Honiss . | |
| 388,614 | 8/1888 | Appel . | |
| 1,995,286 | 3/1935 | Arzet | 383/124 |
| 2,496,796 | 2/1950 | Kardon . | |
| 2,777,368 | 1/1957 | Koop . | |
| 3,185,384 | 5/1965 | Ragan et al. | 383/124 |
| 3,237,534 | 3/1966 | Lissner . | |
| 3,342,402 | 9/1967 | Kardon . | |
| 3,397,622 | 8/1968 | Goodwin . | |
| 3,734,395 | 5/1973 | Erk et al. . | |
| 4,490,131 | 12/1984 | Coleman et al. . | |

FOREIGN PATENT DOCUMENTS

| | | | |
|---|---|---|---|
| 1175846 | 4/1959 | France . | |
| 1188379 | 9/1959 | France | 383/125 |
| 2393673 | 9/1979 | France . | |

*Primary Examiner*—Jes F. Pascua
*Attorney, Agent, or Firm*—Hill, Steadman & Simpson

[57] ABSTRACT

A flat-bottom bag is provided having a folded bottom. Improved adhesive patterns are provided on the bag prior to folding. The bag has a generally planar front wall, a generally planar rear wall which is substantially parallel to the front wall, and a pair of gussetted side walls connecting said front and rear walls. A pair of adhesive patterns are provided, one on an interior of the front wall and one on an interior of the rear wall. Each of the adhesive patterns has a pair of squares. A pair of first flap extensions are provided. Each first flap extension has a pair of overlapping triangular sections. The triangular sections are formed by a folding over of the front wall and the rear wall such that each square is folded over diagonally so that the adhesive pattern will overlie itself. Additional adhesive strips secure the first flap extensions to the bottom. This arrangement provides a securing of all interior edges of the folded bottom.

14 Claims, 1 Drawing Sheet

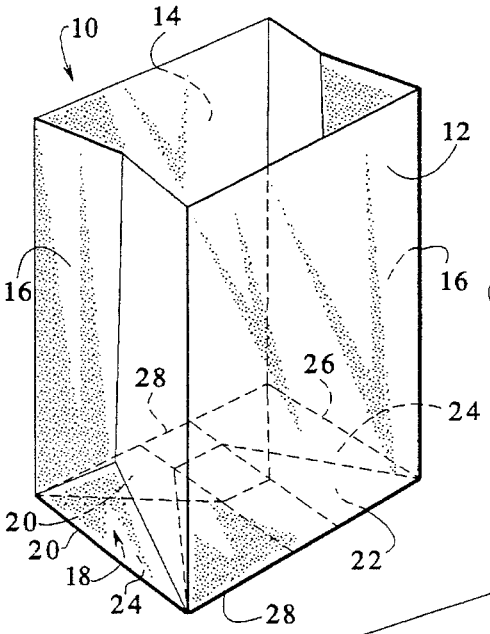
FIG. 1
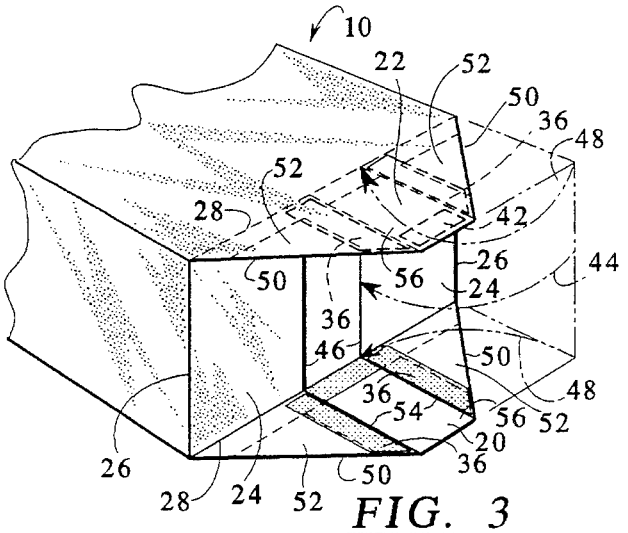
FIG. 3
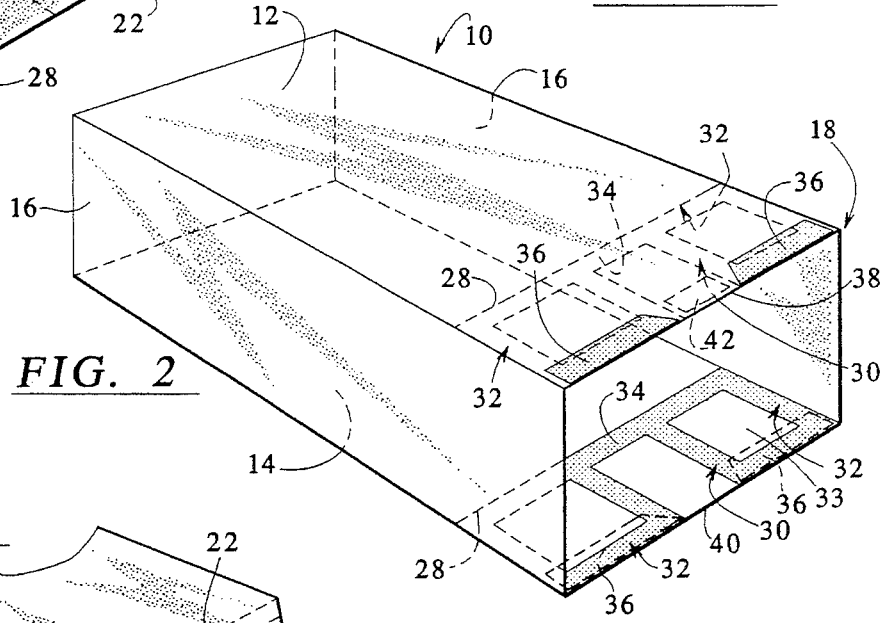
FIG. 2
FIG. 4
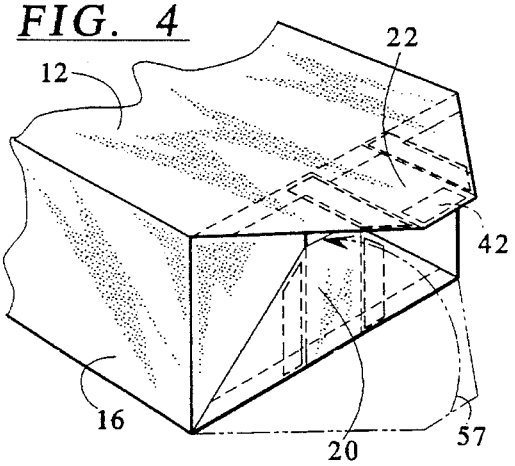
FIG. 5
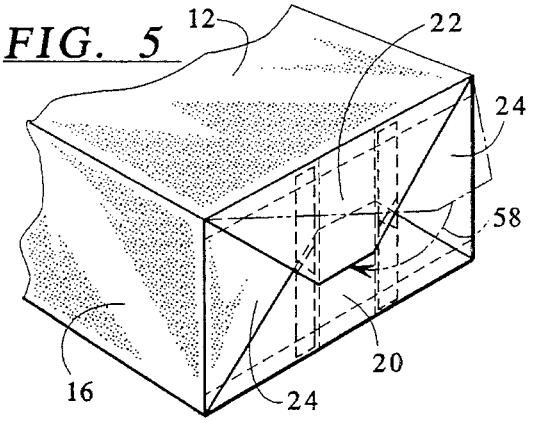

QUASI-HEAT SEAL SOS BAG

BACKGROUND OF THE INVENTION

The present invention relates to bags. More specifically, the present invention relates to self-opening style or self-opening square bags, referred to in the industry as SOS bags. This type of bag has a folded bottom, and is typically used for grocery sacks, lunch sacks, microwave popcorn sacks and other bags which are required to stand on their own when opened. Such SOS bags are disclosed in U.S. Pat. Nos. 3,669,347 and 3,606,822.

Tubular sacks with gussetted sides are known. Because the bottom of such a bag is folded, the interior of the bag has folded-over flaps. Unfortunately, small objects within the bag can become trapped under the flaps, making them difficult to retrieve.

It is known to apply an adhesive to the inside of a tubular bag to form the square bottom. However, the adhesive in prior art bags has not been effectively placed so that the bottom flaps are adequately secured. Some prior art configurations secure interior flaps by gluing an insert strip over certain flap edges. For example, U.S. Pat. No. 3,734,395 relates to such a bag.

SUMMARY OF THE INVENTION

The present invention provides a novel SOS bag which utilizes a tube with gussetted sides having a select pattern of adhesives applied on portions of the interior and exterior of the bag, near one end of the tube. The pattern is such that upon folding of the bag, a flat bottom is achieved which completely secures all interior flap edges.

To this end, in an embodiment, a flat-bottom bag is provided. The bag has a generally planar front wall, a generally planar rear wall substantially parallel to the front wall, and gussetted side walls connecting the front and rear walls. The bag has a bottom end folded to provide a flat bottom. The bottom has first flap extensions of the front and rear walls folded along fold lines. The bottom also has second flap extensions of the side walls. At least one adhesive is arranged adjacent to all interiorly exposed edges of said first and second flap extensions for preventing bag contents from becoming entrapped under the edges.

In an embodiment, one adhesive can be printed and dried on the bag and then reactivated by heat.

In an embodiment, the adhesive is Heat Seal Polyvinyl Acetate.

In an embodiment, the adhesive is Heat Seal Polyvinyl Alcohol.

In an embodiment, the adhesive is positioned in a strip disposed adjacently to the fold lines.

In an embodiment, each of the first flap extensions further has a pair of overlapping triangular sections. The triangular sections are formed by a folding of the first flap extensions to diagonally fold over a square pattern of the adhesive applied to the back thereof.

In an embodiment of the present invention, a flat-bottom bag is provided. The bag has a generally planar front wall, a generally planar rear wall which is substantially parallel to the front wall. There is a pair of adhesive patterns, one on an interior of the front wall and one on an interior of the rear wall. Each of the adhesive patterns has a pair of squares. The bag further has a pair of gussetted side walls connecting said front and rear walls. A pair of first flap extensions are provided. One first flap extension extends from the front wall and the other first flap extension extends from the rear wall. A pair of second flap extensions are provided, each extending from one of the side walls. Each flap extension has a pair of overlapping triangular sections. The triangular sections are formed by a folding over of the front wall and the rear wall such that each square is folded over diagonally.

In an embodiment, a flat-bottom bag is provided having a tube with a generally planar front wall, a generally planar rear wall substantially parallel to the front wall, and side walls connecting the front and rear walls. A bottom end of the tube folded to provide a flat bottom of the bag. The bottom has first flap extensions of the front and rear walls folded along fold lines. The bottom also has second flap extensions of the side walls. The second flap extensions are inwardly folded so that each first flap extension has overlapping triangular side sections folded over at a forty-five degree angle. A first adhesive is arranged interiorly of the tube in a pattern for securing the interior edges of the folded bottom to prevent objects from becoming entrapped under the interior edges. The pattern includes a strip of adhesive adjacent to each fold line and strips of adhesive in a square shape on the tube so that the triangular side sections are formed from a diagonal folding of said square sections. A second adhesive is arranged exteriorly of the tube along an edge of each triangular section for bonding the edge to the second flap extension.

An advantage of the present invention is to provide a bag that prevents objects contained therein from becoming entrapped under edges of a folded bottom.

A further advantage of the present invention is to provide a bag that has an efficient adhesive pattern that results in a beneficial sealing of a folded bottom.

Additional features and advantages of the present invention are described in, and will be apparent from, the detailed description of the presently preferred embodiments and from the drawings.

BRIEF DESCRIPTION OF THE DRAWINGS

FIG. 1 illustrates a perspective view of a folded bag of the present invention.

FIG. 2 illustrates a perspective bottom view of an unfolded bag pursuant to the present invention.

FIG. 3 illustrates a partial perspective bottom view of a partially folded bag of the present invention in an initial folding stage.

FIG. 4 illustrates a partial perspective bottom view of a partially folded bag of the present invention in a second folding stage.

FIG. 5 illustrates a partial perspective bottom view of a folded bag of the present invention in the final folded stage.

DETAILED DESCRIPTION OF THE PRESENTLY PREFERRED EMBODIMENTS

Referring to FIG. 1, a flat-bottom bag 10 is illustrated which has a planar front wall 12, a planar rear wall 14, gussetted side walls 16 which connect the front 12 and rear 14 walls and a bottom 18 which is folded to provide a flat bottom to the bag 10. The bottom 18 is formed of first flap extensions 20 and 22 which are extensions of the from the front 12 and rear 14 walls, respectively, and second flap extensions 24 which are extensions of the sidewalls 16. The second flap extensions 24 are folded along fold lines 26, and the first flap extensions are folded along fold lines 28. Such a bag formation is sometimes referred to as a diamond fold bag.

FIG. 2 illustrates the tubular bag 10 of the invention prior to folding. A pair of interior adhesive patterns 30 are disposed on the interior of the bag 10, one on the front wall 12 and one on the rear wall 14, at the end of the bag 10 near the bottom 18. The interior adhesive patterns 30 are preferably mirror images of each other. Each interior adhesive pattern 30 is generally shaped of a pair of square portions 32, one adjacent to each side wall 16. An interior 33 of each square portion 32 is preferably free of adhesive in order to minimize the amount of adhesive required. Each interior adhesive pattern 28 can include a straight segment 34 which connects each pair of square portions 32.

Also illustrated in FIG. 2 are a plurality of exterior adhesive strips 36. Two exterior adhesive strips 36 are positioned adjacent a bottom edge 38 of the front wall 12, and two exterior adhesive strips 36 are positioned adjacent a bottom edge 40 of the rear wall 14. Each exterior adhesive strip 36 is opposite and approximately equal in length to one of the interior square portions 32. Each exterior adhesive strip 36 extends inwardly from adjacent a side wall 16. Also on the interior of the front wall 12 is a final adhesive strip 42 centered adjacently to the bottom edge 38.

FIG. 3 illustrates the bag in a partially folded stage. The side walls 16 are folded inward, as indicated by an arrow 44, along fold lines 26, forming the second flap extensions 24. The second flap extensions have inner edges 46.

The inward folding 44 results in an overlapping, indicated by arrows 48, of portions of the first flap extensions 20 and 22 by the second flap extensions 24, forming an angled crease 50 at each side of the first flap extensions 20 and 22. Each angled crease 50 is preferably at forty-five degrees and forms an overlapping double-layered triangular section 52. The square adhesive portions 32 described above are arranged so that each angled crease 50 bisects one of the square portions 32 from corner to corner in a diagonal fashion, forming an L-shape. In this way, the square portions 32 of the interior adhesive patterns will overlie one another to provide an effective seal, particularly when the adhesive patterns 32 once heat activated. The segments 34 are not contacted by any other bag portions, and thus provide no bonding or sealing.

Furthermore, an inner edge 54 of each triangular section 52 is contiguous with the inner edge 46 of the adjacent second flap extension 24. On each first flap extension 20 and 22, the inner edges 54 of its respective pair of triangular sections 52 are spaced apart and separated by a rectangular single-layered area 57. Thus, by the folding 44, the adhesive square 32 overlaps itself, forming a bond along inner edges 54 of the respective triangular portion 52 and adjacent to the fold lines 28.

As illustrated in FIG. 4, the first flap extension 20 is then folded inward along the fold line 28, as indicated by an arrow 57. The exterior adhesive strips 36 are aligned to lie against the second flap extensions 24 adjacent to their inner edges 46.

FIG. 5 illustrates the inward folding of the first flap extension 22 along the fold line 28, as indicated by an arrow 58. The first flap extensions 20 and 22 are sized so that they partially overlap each other. The final adhesive strip 42 is positioned on the first flap extension 22 to contact other first flap extension 20 where the first flap extensions 20 and 22 overlap. The first flap extensions 20 and 22 are secured in position by the exterior adhesive strips 36 and the final adhesive strip 42.

From the interior of the bag 10, the separate layers of the triangular portions 52 are open into the interior along the fold lines 28 and along their inner edges 54. The placement of the interior adhesive patterns 30 are such that the bag is secured together along these openings to prevent bag contents from becoming trapped.

Furthermore, the exterior adhesive strips 36 secure the inner edges 54 of the triangular portions 52 to the interior edges 46 of the second flap extensions 24. This prevents objects contained in the bag from entering between the triangular portions 52 and the second flap extensions 24. Similarly, the final adhesive strip 42 secures the two first flap extensions 20 and 22 together to prevent objects from the bag interior from being interposed therebetween.

The interior adhesive patterns 30 are preferably a first adhesive that can essentially be printed and dried on the bag prior to folding. The first adhesive can then reactivated by heat during the bottom-formation process, causing a bond. Especially suited compounds are known as Heat Seal Polyvinyl Acetate and Heat Seal Polyvinyl Alcohol (hereinafter collectively "HS-PVA"). However, other heat reactivated adhesives could be used in lieu of HS-PVA.

The exterior adhesive strips 36 and the final adhesive strip 42 are preferably formed of a bottom paste which can be any glue or paste that can adhere to the bag material to form a bond.

When the bottom 18 has been completely folded, as illustrated in FIG. 5, heat is applied to reactivate the first adhesive. This forms a complete securing of the folded bottom 18.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A flat-bottom bag formed from a bag blank comprising:

a generally planar front wall;

a generally planar rear wall substantially parallel to said front wall;

a pair of gussetted side walls connecting said front and rear walls;

a pair of first flap extensions, one of said first flap extensions extending from said front wall and the other of said first flap extensions extending from said rear wall;

a pair of second flap extensions, each extending from one of said side walls;

a pair of adhesive patterns, one on an interior of said front wall and one on an interior of said rear wall, each of said adhesive patterns comprising a pair of squares prior to a folding of said front and rear walls to form said bag;

wherein each flap extension has a pair of overlapping triangular sections, said triangular sections being formed by a folding over of said front wall and said rear wall such that each of said squares is folded over diagonally to form an L-shape upon formation of said bag.

2. A bag according to claim 1 wherein said adhesive patterns are made of an adhesive that can be printed and dried on said bag and then reactivated by heat.

3. A bag according to claim 2 wherein said adhesive is Heat Seal Polyvinyl Acetate.

4. A bag according to claim 2 wherein said adhesive is Heat Seal Polyvinyl Alcohol.

5. A bag according to claim 1 further comprising adhesive strips arranged adjacently to said triangular sections for securing said first flap extensions to said second flap extensions.

6. A bag according to claim 5, wherein said adhesive strips also secure said first flap extensions together at an overlapping region.

7. A bag according to claim 1, further comprising:

two pairs of adhesive strips, one being arranged on an exterior edge of said front wall and the other arranged on an exterior edge of said rear wall;

wherein the adhesive strips are arranged such that, upon folding of the bag, at least one said adhesive strip is disposed along an edge of each triangular section, the adhesive strips contacting between the first flap extensions and second flap extensions and between an overlapping region of said first flap extensions.

8. A bag according to claim 1, further comprising:

a final adhesive strip on an interior of said front wall at an edge thereof between said squares, the final adhesive strip being arranged such that, upon a folding of said bag, the final adhesive strip contacts between overlapping regions of said first flap extensions between said triangular sections.

9. A flat-bottom bag comprising:

a tube having a generally planar front wall, a generally planar rear wall substantially parallel to said front wall, and side walls connecting said front and rear walls;

a bottom end of said tube folded to provide a flat bottom of said bag, said bottom comprising first flap extensions of said front and rear walls folded along fold lines, and second flap extensions of said side walls, said second flap extensions being inwardly folded so that each of said first flap extensions has overlapping triangular side sections folded over at a forty-five degree angle;

a first adhesive arranged interiorly of said tube in a pattern for preventing objects from becoming interposed under interior edges of said folded flat bottom, said pattern comprising a strip of adhesive adjacent to each said fold line and strips of adhesive in a square shape prior to folding of the flap extensions so that said triangular side sections are formed by diagonally folding said square adhesive sections into L-shaped adhesive sections; and a second adhesive arranged exteriorly of said tube along an edge of each of said triangular sections for bonding said edge to said second flap extension.

10. A bag according to claim 9 wherein said first adhesive is printed and dried on said bag prior to folding said walls of said tube to form said flat bottom and is reactivated by heat during the bottom-formation process.

11. A bag according to claim 10 wherein said first adhesive is Heat Seal Polyvinyl Acetate.

12. A bag according to claim 10 wherein said first adhesive is Heat Seal Polyvinyl Alcohol.

13. A bag according to claim 9, wherein said second adhesive further bonds between overlapping regions of said first flap extensions.

14. A bag according to claim 9, further comprising:

a final adhesive strip on an interior of said front wall at an edge thereof between said squares, the final adhesive strip being arranged such that, upon a folding of said bag, the final adhesive strip contacts between overlapping regions of said first flap extensions between said triangular sections to prevent objects from becoming interposed between said first flap extensions.

* * * * *